US007743477B2

(12) United States Patent
Sakamoto et al.

(10) Patent No.: US 7,743,477 B2
(45) Date of Patent: Jun. 29, 2010

(54) METHOD OF MANUFACTURING A MULTI-NOZZLE INK JET HEAD

(75) Inventors: Yoshiaki Sakamoto, Kawasaki (JP); Shuji Koike, Setagaya (JP); Tomohisa Shingai, Kawasaki (JP)

(73) Assignee: Fuji Photo Film Co., Ltd., Minami-Ashigara-shi (JP)

( * ) Notice: Subject to any disclaimer, the term of this patent is extended or adjusted under 35 U.S.C. 154(b) by 25 days.

(21) Appl. No.: 12/222,137

(22) Filed: Aug. 4, 2008

(65) Prior Publication Data

US 2008/0295309 A1 Dec. 4, 2008

Related U.S. Application Data

(60) Division of application No. 11/066,777, filed on Feb. 28, 2005, now Pat. No. 7,425,058, which is a division of application No. 10/255,615, filed on Sep. 27, 2002, now Pat. No. 6,877,843, which is a continuation of application No. PCT/JP00/01880, filed on Mar. 27, 2000.

(51) Int. Cl.
*B21D 53/76* (2006.01)

(52) U.S. Cl. ..... 29/25.35; 29/890.1; 347/45; 347/68; 347/70; 347/71

(58) Field of Classification Search ..... 29/25.35, 29/890.1, 830; 347/45, 64, 68–71
See application file for complete search history.

(56) References Cited

U.S. PATENT DOCUMENTS

| | | | | |
|---|---|---|---|---|
| 4,947,184 A | | 8/1990 | Moynihan | 346/1.1 |
| 5,752,303 A | * | 5/1998 | Thiel | 29/25.35 |
| 5,818,482 A | | 10/1998 | Ohta et al. | 347/70 |
| 6,142,614 A | | 11/2000 | Hashizume et al. | 347/70 |
| 6,626,525 B1 | | 9/2003 | Nakamura et al. | 347/70 |
| 2001/0015740 A1 | | 8/2001 | Kitahara | 347/68 |

(Continued)

FOREIGN PATENT DOCUMENTS

| | | |
|---|---|---|
| EP | 0 505 188 | 9/1992 |

(Continued)

OTHER PUBLICATIONS

Tay Eng Hock et al, "Designing a Fluid Pump for Microfluidic Cooling Systems in Electronic Components", Proceedings of the 1997 1st Electronic Packaging Technology Conference, 1997, pp. 115-118, Oct. 8, 1997.*

*Primary Examiner*—A. Dexter Tugbang
(74) *Attorney, Agent, or Firm*—Kratz, Quintos & Hanson, LLP

(57) ABSTRACT

A manufacturing method for a multi-nozzle ink jet head using piezoelectric elements. The head has a nozzle member in which a plurality of nozzles are formed, a pressure chamber wall member in which a plurality of pressure chambers are formed, and piezoelectric type actuators that have a diaphragm and a plurality of piezo elements and apply pressure to each of the plurality of pressure chambers for ejecting ink from the nozzles. A coating member having high rigidity is provided on inner surfaces of the pressure chamber walls or on parts of the diaphragm in contact with the pressure chamber wall member, thus increasing the rigidity of the pressure chamber walls.

3 Claims, 14 Drawing Sheets

U.S. PATENT DOCUMENTS

| | | | | |
|---|---|---|---|---|
| 2002/0047879 | A1 | 4/2002 | Watanabe et al. | 347/68 |

FOREIGN PATENT DOCUMENTS

| | | | | |
|---|---|---|---|---|
| EP | 0 803 918 | | 10/1997 | |
| JP | 05254131 | A * | 10/1993 | 29/890.1 X |
| JP | 05-338163 | | 12/1993 | |
| JP | 06-071877 | | 3/1994 | |
| JP | 06-218929 | | 8/1994 | |
| JP | 06-297711 | | 10/1994 | |
| JP | 09-277532 | | 10/1997 | |
| JP | 10-100405 | | 4/1998 | |
| JP | 10-146967 | | 6/1998 | |
| JP | 10-264383 | | 10/1998 | |
| JP | 2000-85118 | | 3/2000 | |

* cited by examiner

| | Helmholz Frequency (Hz) | Initial speed of ink particle when ink particle amount is 2 picoliters (m/s) |
|---|---|---|
| Prior art | 253.8 | 7.1 |
| Example 4 | 361.6 | 10.1 |
| Example 5 | 393.8 | 11.0 |
| Example 5-2 | 414.3 | 11.6 |
| Example 6 | 323.8 | 9.0 |
| Example 1 | 287.1 | 8.0 |
| Example 2 | 340.9 | 9.5 |
| Example 3 | 357.1 | 10.0 |
| Example 7 | 365.7 | 10.2 |

FIG. 15

| | Comparative result when value for conventional example is made to be '1' | | |
|---|---|---|---|
| | Pressure chamber wall loss ratio | Helmholtz frequency ratio | Initial speed of ink particle ratio |
| Prior art | 1 | 1 | 1 |
| Example 4 | 0.83 | 1.42 | 1.43 |
| Example 5 | 0.81 | 1.55 | 1.55 |
| Example 5-2 | 0.69 | 1.63 | 1.63 |
| Example 6 | 0.91 | 1.28 | 1.28 |
| Example 1 | 0.67 | 1.13 | 1.13 |
| Example 2 | 0.80 | 1.34 | 1.34 |
| Example 3 | 0.84 | 1.41 | 1.41 |
| Example 7 | 0.84 | 1.44 | 1.44 |

METHOD OF MANUFACTURING A MULTI-NOZZLE INK JET HEAD

RELATED APPLICATIONS

This application is a Division of U.S. Ser. No. 11/066,777, filed Feb. 28, 2005, now U.S. Pat. No. 7,425,058, which is a Division of U.S. Ser. No. 10/255,615, filed Sep. 27, 2002, now U.S. Pat. No. 6,877,843, which is a Continuation of International Application No. PCT/JP00/01880, filed Mar. 27, 2000, the contents of which are incorporated herein by reference. This application corresponds to co-pending U.S. Ser. Nos. 11/066,286, filed Feb. 28, 2005 and 11/896,844, filed Sep. 6, 2007, the contents of which are incorporated herein by reference.

FIELD OF THE INVENTION

The present invention relates to a multi-nozzle ink jet head having a plurality of nozzles and a manufacturing method thereof, and in particular to a multi-nozzle ink jet head for increasing the rigidity of pressure chamber walls and a manufacturing method thereof.

BACKGROUND ART

FIG. 17 is a drawing of the constitution of a conventional multi-nozzle ink jet head. Here, a bimorph actuator in which a diaphragm 95 and a piezo 96 are laminated together is used as a driving element.

Regarding the method of manufacturing the driving elements and the head 90, a plurality of individual electrodes 97 are formed by sputtering on an MgO substrate, not shown, the piezos 96 are further laminated on to a thickness of a few μm, and pattern formation is carried out. Then, a metal (for example Cr) that will become the common electrode cum diaphragm 95 is formed to a few μm over the whole surface, thus forming the bimorph structures. A pressure chamber-forming member (dry film resist) 93 and a nozzle-forming member 92, which are prepared separately, are joined on in alignment with the individual electrodes 97. Then, the MgO substrate is removed by etching, thus completing the head plate 90.

Regarding the operation, ink is fed to the head 90 from an ink tank, not shown, and then within the head 90, the ink is fed to the pressure chambers 94 and nozzles 12 via a common channel and ink supply channels, not shown. Driving signals are applied to the individual electrodes 97 (the electrodes corresponding to the respective nozzles) from a driving circuit, whereupon, due to the piezoelectric effect of the piezo 96, the diaphragm 95 deflects towards the inside of the pressure chamber 94 as shown by the dashed lines in FIG. 17, and ink is ejected from the nozzle 12. The ink forms dots on a printing medium, and by controlling the driving of the apparatus and the head, a desired image is formed.

With an ink jet head using such thin-film piezos, the ejection of ultra-small particles is possible, thus raising the printing quality, and moreover a semiconductor manufacturing method can easily be applied, and hence a small head with a plurality of nozzles at high density can be realized at low cost.

However, as shown in FIG. 17, in the case that the nozzle density is made high, the pressure chamber walls 93 that connect between adjacent nozzles 12 become thin, and the rigidity drops. For example, with a head having a nozzle density of 300 dpi, the nozzle pitch is low at 85 μm, and the thickness of the pressure chamber walls is 35 μm or less. This drop in the rigidity of the pressure chamber walls 93 causes a loss of generated pressure during driving, a drop in the responsiveness of ink flow, and as a result a drop in the particle formation speed and the driving frequency. In particular, if the pressure chamber wall member 93 is a resin such as a dry film resist, then the drop in the rigidity of the pressure chamber walls is marked.

To suppress these effects, conventionally a method in which the pressure chamber walls 93 are made thick, and a method in which the pressure chamber-forming member 93 is made to be a metal or the like, which has a higher rigidity than a resin, have been proposed, and as a result the rigidity of the pressure chamber walls 93 can be secured.

However, making the pressure chamber walls 93 thicker makes it impossible to make the nozzle density high from a structural perspective. Moreover, if the pressure chamber-forming member 93 is made to be metal, then it is necessary to form the pressure chamber pattern with an accuracy of a few μm at a pressure chamber depth (metal layer thickness) of a few tens of μm. This results in a high cost. With these countermeasures, it is thus difficult to achieve a high nozzle density at low cost.

DISCLOSURE OF THE INVENTION

It is an object of the present invention to provide a multi-nozzle ink jet head and manufacturing method thereof for preventing the loss of generated pressure during driving, even if the pressure chamber walls are made thin to increase the nozzle density.

It is another object of the present invention to provide a multi-nozzle ink jet head and manufacturing method thereof for increasing the rigidity of the pressure chamber walls, even if a low-rigidity pressure chamber wall material is used.

It is yet another object of the present invention to provide a multi-nozzle ink jet head and manufacturing method thereof for preventing a drop in the displacement of the piezoelectric actuators, even if the pressure chamber walls are made thin.

It is yet another object of the present invention to provide a multi-nozzle ink jet head and manufacturing method thereof for enabling the nozzle density to be made high at low cost.

To attain these objects, one form of the multi-nozzle ink jet head of the present invention has a nozzle member in which is formed a plurality of nozzles, a pressure chamber wall member in which is formed a plurality of pressure chambers, piezoelectric type actuators that apply pressure to each of the plurality of pressure chambers for ejecting ink from the nozzles, and a reinforcing coating member that is provided on surfaces of the pressure chamber wall member facing the pressure chambers and reinforces the pressure chamber wall member.

A method of manufacturing the multi-nozzle ink jet head of the present invention has a step of producing piezoelectric type actuators that apply pressure to each of a plurality of pressure chambers for ejecting ink from the nozzles, and a step of forming, on the piezoelectric type actuators, a pressure chamber wall member in which is formed the plurality of pressure chambers, and a nozzle member in which is formed the plurality of nozzles, wherein the step of forming the pressure chamber wall member has a step of coating a reinforcing member that reinforces the pressure chamber wall member onto surfaces of the pressure chambers of the pressure chamber wall member.

With this form of the present invention, a reinforcing member is coated onto the pressure chamber walls to increase the rigidity of the pressure chamber walls. As a result, even if the pressure chamber walls have been made thin to make the nozzle density high, escape of the pressure chamber walls due to the pressure from the piezoelectric actuators can be prevented, and hence pressure loss can be reduced. A structure can thus be realized for which the Helmholtz frequency is raised even if the nozzle density is made high, and the particle formation speed and the driving frequency can be improved. Moreover, because the reinforcement is carried out using a coating, the reinforcing layer may be thin, and hence the reinforcement can be realized without making the width of the pressure chambers narrow.

Note that, in the case of a multi-nozzle head, the idea of coating some kind of layer onto the pressure chamber walls is known (for example, Japanese Patent Application Laid-open No. 5-338163, Japanese Patent Application Laid-open No. 10-100405, Japanese Patent Application Laid-open No. 10-264383 etc.). However, in this prior art, pressure chamber walls made of metal are protected from alkaline inks using a metal layer or a resin layer; it is not an intention to reinforce the pressure chamber walls.

Moreover, with the multi-nozzle ink jet head of the present invention, the above-mentioned pressure chamber wall member can be constituted from a photosensitive resin, and the above-mentioned reinforcing coating member can be constituted from a metal or a ceramic material. Even if a photosensitive resin, which enables minute pressure chambers to be formed easily through a semiconductor process, is used as the pressure chamber walls, the rigidity of the pressure chamber walls can easily be raised.

Furthermore, with the multi-nozzle ink jet head of the present invention, the above-mentioned reinforcing coating member can be constituted from an electrically conductive member, and the reinforcing coating member, which is provided on each of the pressure chambers of the pressure chamber wall member, can be electrically connected together. As a result, the reinforcing coating member also functions as the common electrode of the piezoelectric actuators.

Furthermore, with the multi-nozzle ink jet head of the present invention, the piezoelectric type actuators have piezo elements and a diaphragm, and the diaphragm can be constituted from the above-mentioned reinforcing coating member. As a result, the diaphragm and the reinforcing layer can be formed simultaneously, and hence the head manufacturing process can be simplified.

Furthermore, with the multi-nozzle ink jet head of the present invention, the thickness of the reinforcing coating member constituting the diaphragm can be made to be thinner than the thickness of the reinforcing coating member covering the pressure chamber wall member. As a result, the function of a diaphragm and the function of a reinforcing layer can both be achieved.

Furthermore, with the multi-nozzle ink jet head of the present invention, by making the thickness of the reinforcing coating member satisfy the following conditions, pressure chamber walls giving little pressure loss can be constituted using desired pressure chamber walls and a desired coating material.

When $20 \leqq E1/E2$, $0.02 \leqq t1/tw$, when $40 \leqq E1/E2$, $0.01 \leqq t1/tw$, when $80 \leqq E1/E2$, $0.005 \leqq t1/tw$, when $400 \leqq E1/E2$, $0.001 \leqq t1/tw$.

Here, E1 is the Young's modulus of the coating material, E2 is the Young's modulus of the pressure chamber wall core material, t1 is the thickness of the coating material, t2 is the thickness of the pressure chamber wall core material, and tw ($=2\times t1+t2$) is the total thickness of each pressure chamber wall.

The multi-nozzle ink jet head according to another form of the present invention has a nozzle member in which is formed a plurality of nozzles, a pressure chamber wall member in which is formed a plurality of pressure chambers, piezoelectric type-actuators that have a diaphragm and a plurality of piezo elements, and apply pressure to each of the plurality of pressure chambers for ejecting ink from the nozzles, and a high-rigidity member for forming parts of the pressure chambers that is provided at parts of the diaphragm in contact with the pressure chamber wall member.

A method of manufacturing the multi-nozzle ink jet head according to this other form of the present invention has a step of producing piezoelectric type actuators having a diaphragm and a plurality of piezo elements, and a step of forming, on the piezoelectric type actuators, a pressure chamber wall member in which is formed the plurality of pressure chambers, and a nozzle member in which is formed the plurality of nozzles, wherein the step of producing the piezoelectric type actuators has a step of forming a high-rigidity member that forms parts of the pressure chambers in positions of the diaphragm in contact with the pressure chamber wall member.

With this form of the present invention, in a constitution in which the diaphragm, which forms part of the pressure chamber surfaces, is subjected to flexural deformation, by providing the high-rigidity member, the rigidity of fixed parts of the diaphragm can be raised such that the deformation efficiency of the diaphragm is improved. Most other parts of the pressure chamber walls may be a low-rigidity material such as a resin, and hence even in the case of a high nozzle density, pressure loss can be reduced, and as a result a structure for which the Helmholtz frequency is raised can be realized, and the particle formation speed and the driving frequency can be increased.

Moreover, with the multi-nozzle ink jet head of the present invention, by making the high-rigidity member have a shape tapering towards the diaphragm, stress arising at diaphragm supporting parts can be relaxed.

Other objects and forms of the present invention will become apparent from the following embodiments and drawings.

BRIEF DESCRIPTION OF THE DRAWINGS

FIG. 15 is a table comparing the pressure chamber wall loss and head operating characteristics for the examples of the present invention.

BEST MODE FOR CARRYING OUT THE INVENTION

Figure 1:
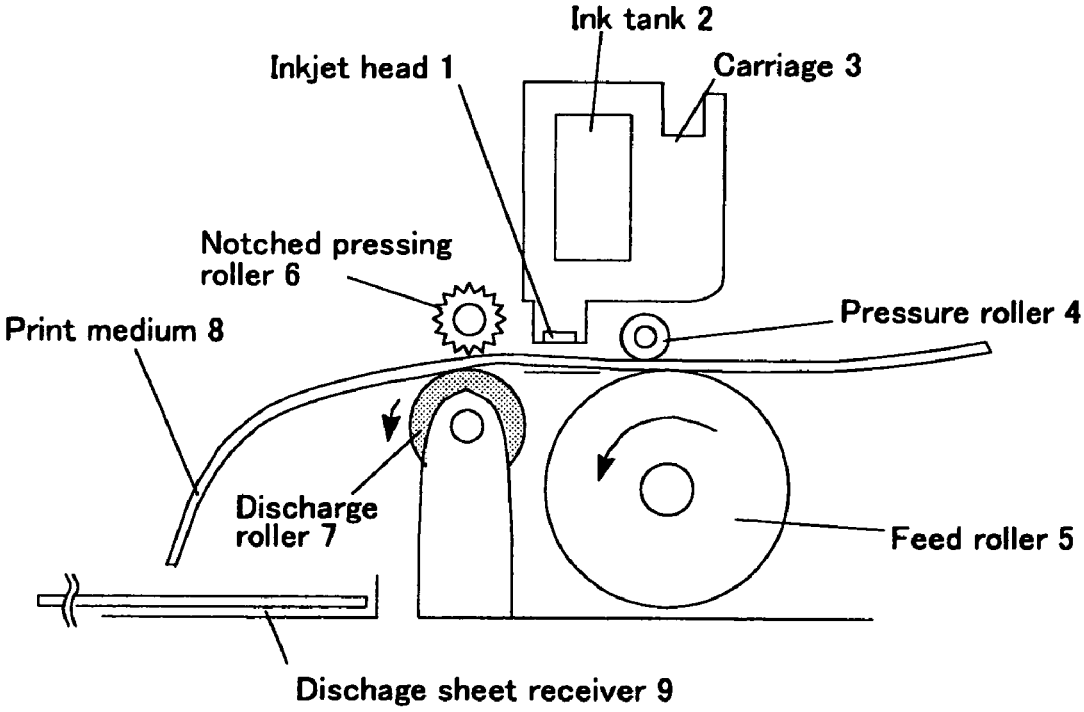
FIG. 1 is a drawing of the constitution of a printer to which the multi-nozzle ink jet head of the present invention is applied.

FIG. 1 is a drawing of the constitution of a printer using the multi-nozzle ink jet head of the present invention; a serial printer has been taken as an example. In FIG. 1, a carriage 3 mounts an ink tank 2 that stores ink and a multi-nozzle ink jet head 1 (hereinafter referred to as the 'head'), and moves in the main scanning direction of a printing medium 8. The printing medium 8 is conveyed in the direction of the head 1 by a pressing roller 4 and a paper-feeding roller 5. A notched pressing roller 6 and a paper-discharging roller 7 convey the printing medium 8 into a discharged paper receiver 9. Through the-movement of the carriage 3 in the main scanning direction and the conveyance of the printing medium 8 in the sub scanning direction, the head 1 can thus print over the whole of the printing medium 8.

Figure 2:
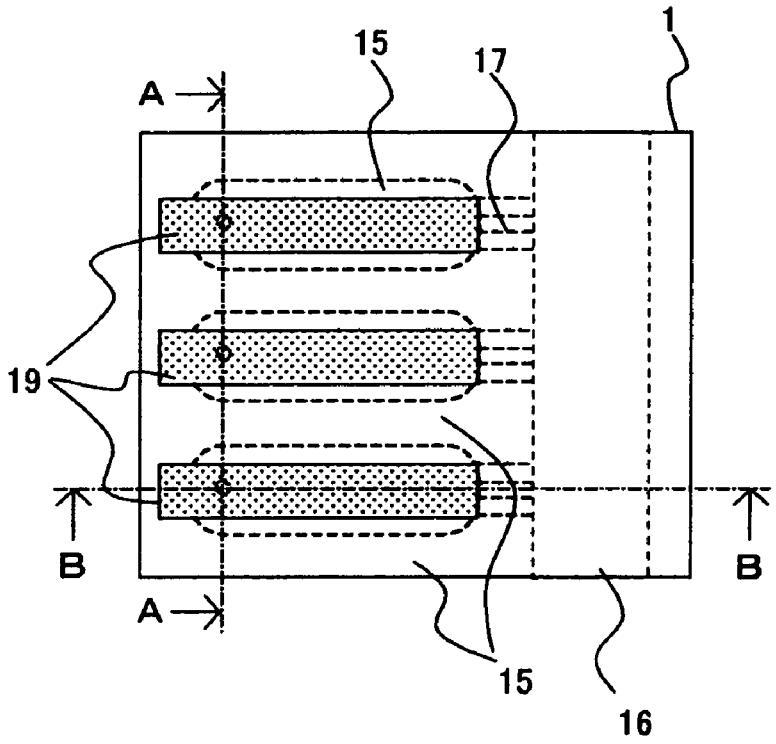
FIG. 2 is a top view of a head of an embodiment of the present invention.
Figure 3:
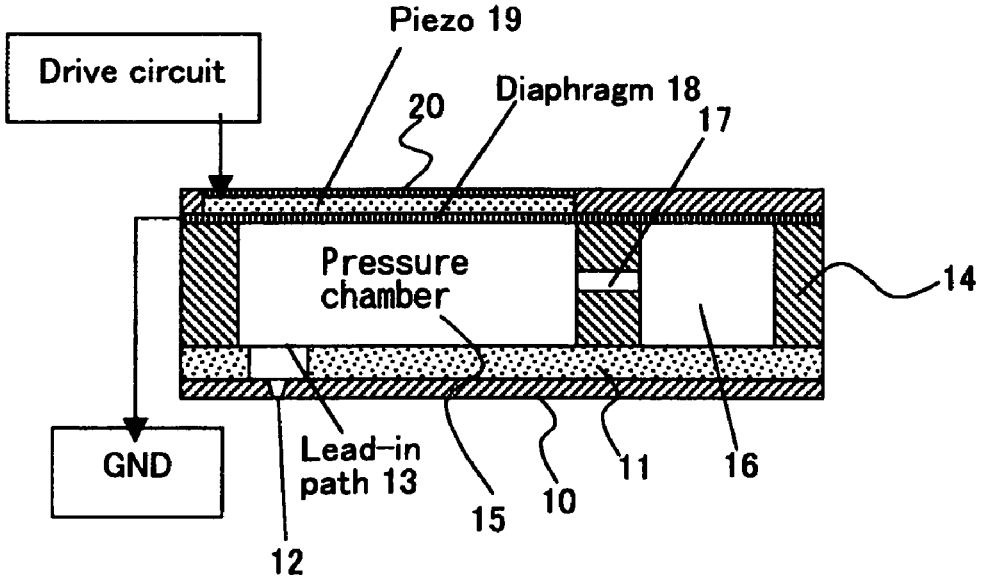
FIG. 3 is a sectional view of the head of FIG. 2 along B-B.

FIG. 2 is a top view of the head of an embodiment of the present invention, and FIG. 3 is a sectional view of the head of FIG. 2 along B-B. FIG. 2 shows a multi-nozzle head having three nozzles and three piezo elements 19 and three pressure chambers 15 are provided to a common ink chamber 16 via ink supply channels 17.

As shown in FIG. 3, a lead-through channel plate 11 in which are formed lead-through channels 13 is provided on a nozzle plate 10 in which are formed the nozzles 12. A pressure chamber wall member 14 in which are formed the pressure chambers 15, the ink supply channels 17 and the common ink chamber 16 is provided thereabove. A diaphragm 18 that is also used as a common electrode is provided so as to cover each of the pressure chambers 15 and the three piezo films 19 for the respective pressure chambers are provided on the diaphragm 18, and an individual electrode 20 is provided on each of the piezo films 19.

Regarding the operation of the head, ink is fed from the ink tank 2 in FIG. 1 to the head 1, and then within the head 1, the ink passes through the common chamber 16 and the ink supply channels 17 and is fed to each of the pressure chambers 15 and nozzles 12. As shown in FIG. 3, the diaphragm 18 is electrically earthed, and by applying driving signals to the individual electrodes (the electrodes corresponding to the respective nozzles) 20 from a driving circuit, due to the piezoelectric effect of the piezo 19, the diaphragm 18 deflects towards the inside of the pressure chamber 15, and ink is ejected from the nozzle 12. The ink forms dots on the printing medium, and by controlling the driving of the apparatus and the head, a desired image is formed.

The piezo films 19 are formed extremely thinly by a semiconductor process. With an ink jet head using thin film piezos, ejection of ultra-small particles is possible, thus raising the printing quality, and moreover a semiconductor manufacturing method can easily be applied, and hence a small head with a plurality of nozzles at high density can be realized at low cost.

Figure 4A:
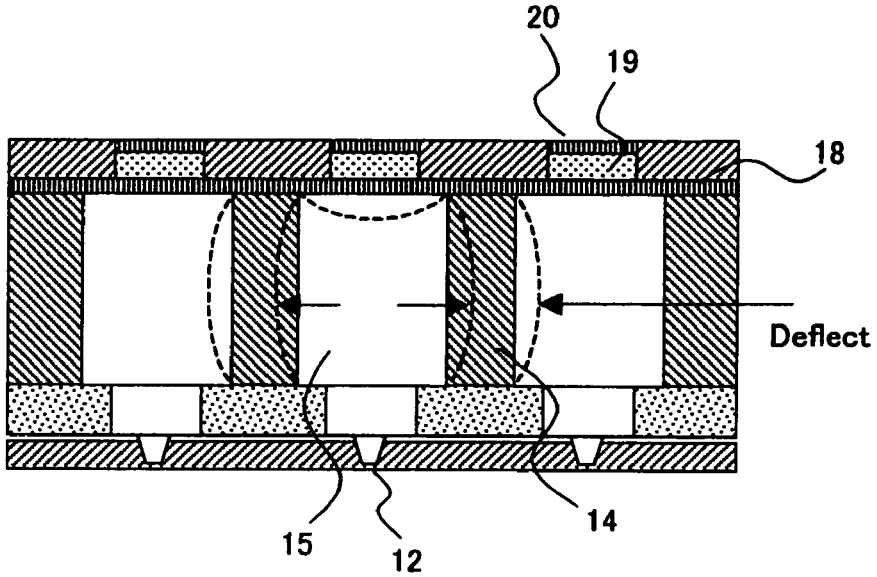
FIGS. 4(A) and 4(B) consist of drawings explaining the operation of the present invention.

However, as shown in FIG. 4(A), if the nozzle density is made high, then the pressure chamber walls 14 that connect between adjacent nozzles 12 become thin, and the rigidity drops. For example, with a head having a nozzle density of 300 dpi, the nozzle pitch is low at 85 .mu.m, and the thickness of the pressure chamber walls is 35 .mu.m or less. Due to the drop in the rigidity of the pressure chamber walls 14, as shown in FIG. 4(A), the pressure chamber walls 14 deflect (retreat) in the direction of the arrows due to the generated pressure (ink pressure) received by the ink in the pressure chamber 15 during driving, and hence pressure loss occurs.

Figure 4B:
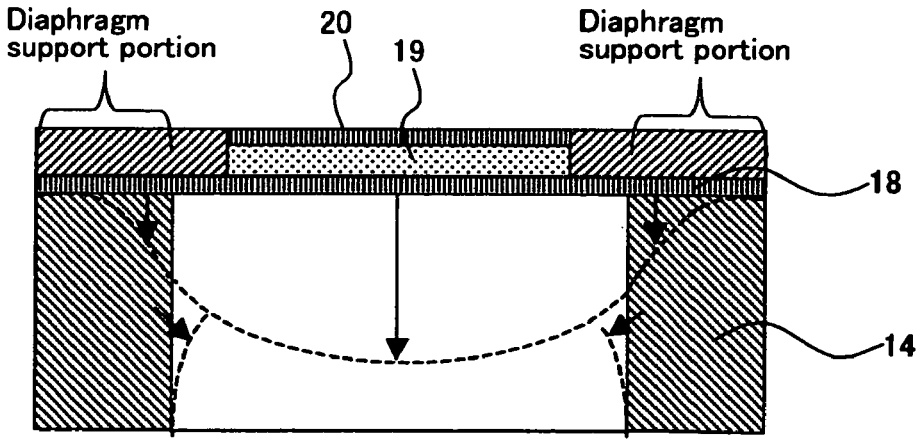

Moreover, as shown in FIG. 4(B), because the rigidity of the supporting parts for the diaphragm 18 becomes low, the diaphragm supporting parts also displace, and hence energy is wasted through unnecessary movement, and there is a loss of generated pressure. Consequently, generated pressure is allowed to escape, the responsiveness of the ink flow is reduced, and as a result the particle formation speed and the driving frequency are reduced. In particular, if the pressure chamber wall member 14 is a resin such as a dry film resist, then the drop in the rigidity of the pressure chamber walls is marked.

To reduce this pressure loss, in the present invention, firstly the rigidity of the pressure chamber walls 14 is increased. Secondly, the rigidity of the supporting parts for the diaphragm 18 is increased. Examples of the present invention are shown in FIGS. 5 to 13 below. Each figure is a cross-section of the pressure chambers (the section A-A along the direction in which the plurality of pressure chambers are arranged in FIG. 2). Basically, the driving elements are bimorph actuators each comprising a laminate of the diaphragm and a thin-film piezo, and the method of manufacturing the thin-film piezos is as in conventional examples. The method of forming the diaphragm and the pressure chamber walls is different for each example, with the process flow of the method being shown in the respective figure.

Here, to compare the characteristics of a conventional example and each of the examples of the present invention, the following conditions are made to be common to all.

Individual electrodes 20: width 45 (μm), thickness 0.1 (μm)

Thin film piezos 19: piezoelectric constant d31 100E-12 (m/V), width 45 (μm), thickness 2 (μm)

Pressure chambers 15: length 500 (μm), width 50 (μm), depth 50 (μm)

Pitch of nozzles 12: 85 (μm) (=300 dpi)

Thickness of pressure chamber walls=nozzle pitch-width of pressure chambers=35 (μm)

Nozzles 12: length 15 (μm), diameter 15 (μm)

Nozzles formed by excimer laser processing of polyimide (PI) sheet 10

Lead-through channels 13: length 30 (μm), diameter 40 (μm)

Ink flow channels formed by etching SUS sheet 11

Following is a description of each of the examples, with a comparison of the characteristics being given later.

Example 1

Figure 5:
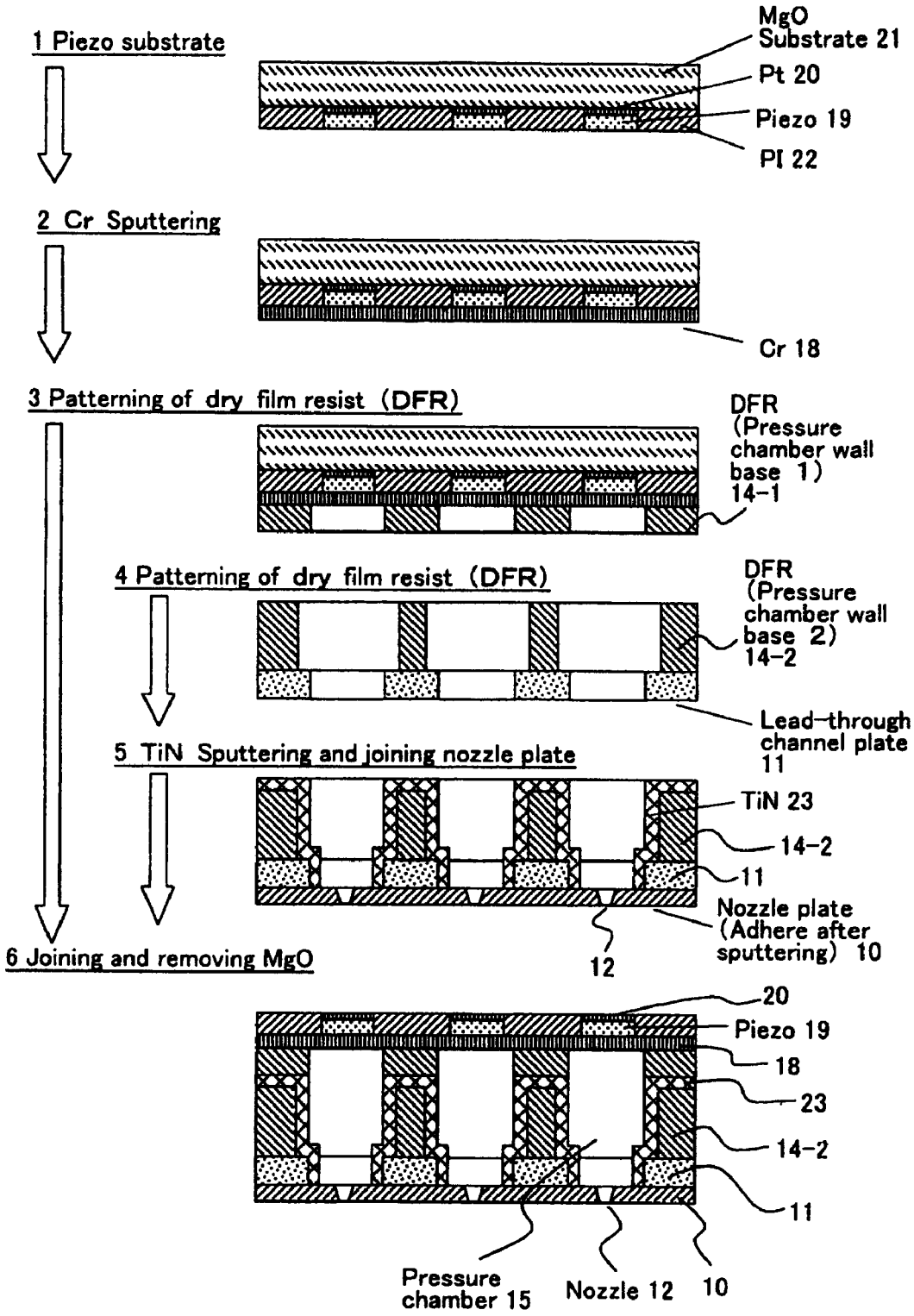
FIG. 5 consists of drawings explaining a first example of the present invention.

FIG. 5 consists of drawings explaining a first example of the present invention, and shows the manufacturing process flow and the structure of the head.

(1) A piezo substrate is formed. That is, individual electrodes 20 are formed from Pt on a process substrate 21 (for example MgO), and then piezo films 19 are formed on the individual electrodes 20 by a sputtering method or the like. Moreover, the gaps between the piezo films 19 are made flat using a polyimide (PI) 22.

(2) A common electrode cum diaphragm 18 is formed over the whole of the piezo substrate of (1) by Cr sputtering. The thickness is 1 (μm).

(3) First pressure chamber wall base parts 14-1 are formed by dry film resist patterning on the common electrode cum diaphragm 18. The height is 20 (μm), and the width is 35 (μm).

(4) Second pressure chamber wall base parts 14-2 are formed by dry film resist patterning on a lead-through channel plate 11 that has been produced separately. The height is 29 (μm), and the width is 35−t1×2=33 (μm); regarding t1, see (5) below.

(5) A reinforcing coating layer 23 is formed by TiN sputtering over the whole pattern of the members of (4). The thickness t1 of the coating on the pressure chamber wall surfaces is 1 (μm). Then, a nozzle plate 10 in which nozzles 12 have been formed is joined to the lead-through channel plate 11.

(6) The members of (3) and the members of (5) are aligned and joining is carried out with heating, and then the piezo substrate MgO 21 is removed by etching, thus completing the manufacture.

In this example, the pressure chamber walls 14 are formed to high density from a dry film resist using semiconductor processes. The dry film resist is a resin, and has low rigidity. A TiN high-rigidity material is thus coated onto the walls 14, thus increasing the rigidity of the pressure chamber walls 14. Deflection of the pressure chamber walls 14 as shown in FIG. 4(A) can thus be prevented.

Example 2

Figure 6:
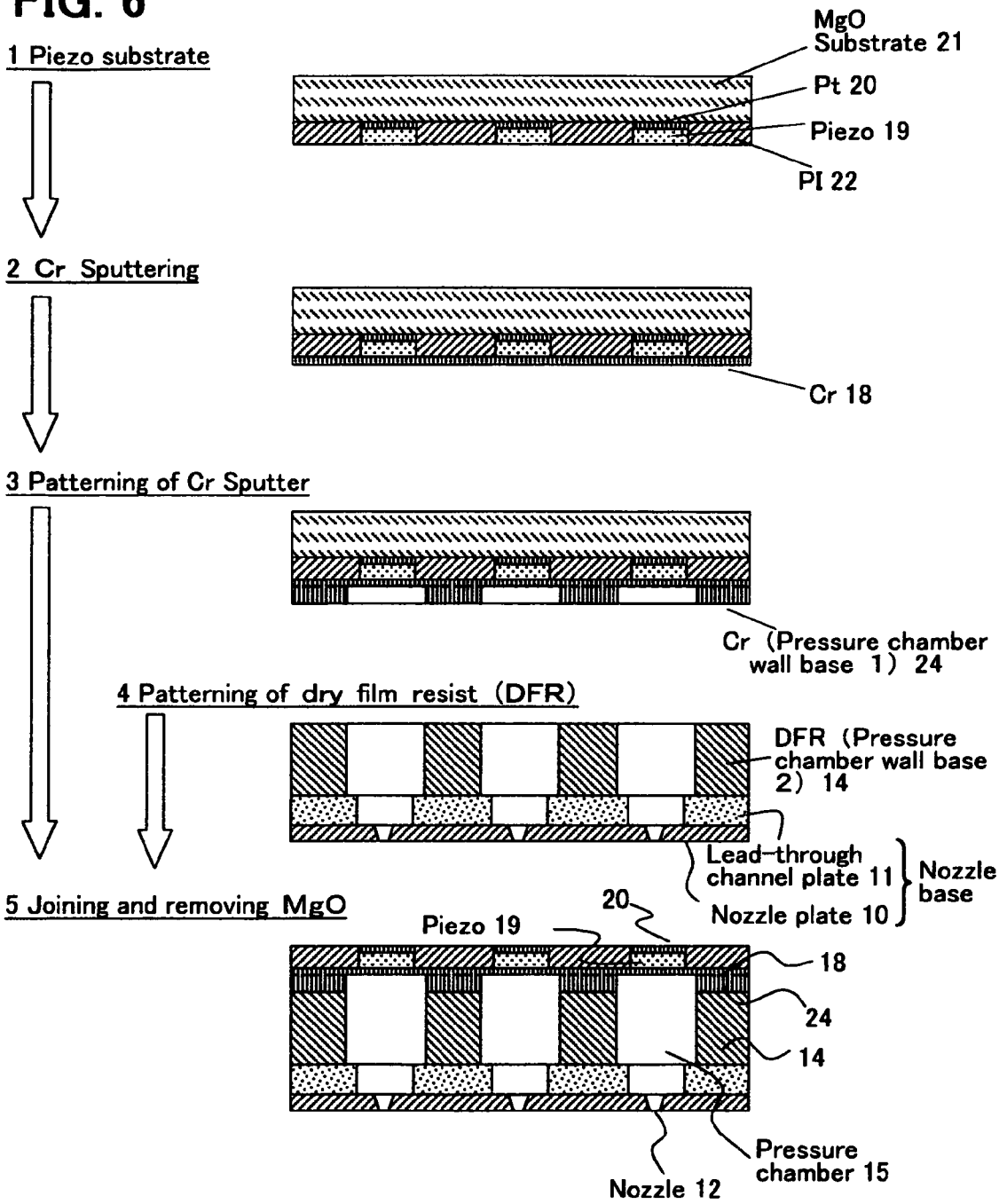
FIG. 6 consists of drawings explaining a second example of the present invention.

FIG. 6 consists of drawings explaining a second example of the present invention.

(1) A piezo substrate is formed. That is, individual electrodes 20 are formed from Pt on a process substrate 21 (for example Mgo), and then piezo films 19 are formed on the individual electrodes 20 by a sputtering method or the like. Moreover, the gaps between the piezo films 19 are made flat using a polyimide (PI) 22.

(2) A common electrode cum diaphragm 18 is formed over the whole of the piezo substrate of (1) by Cr sputtering. The thickness is 1 (μm).

(3) Pressure chamber wall base parts 24 are formed by patterning a Cr sputtered film on the diaphragm 18 of (2). The height is 10 (μm), and the width is 35 (μm).

(4) Pressure chamber wall base parts 14 are formed by dry film resist patterning on a nozzle substrate (a laminated plate of a nozzle plate 10 and a lead-through channel plate 11) that has been produced separately. The height is 40 (μm), and the width is 35 (μm).

(5) The members of (3) and the members of (4) are aligned, joining is carried out with heating, and then the piezo substrate MgO 21 is removed by etching, thus completing the manufacture.

In this example, the pressure chamber walls 14 are formed to high density from a dry film resist using a semiconductor process. The dry film resist is a resin, and has low rigidity. Cr, a high-rigidity material is used for securing and supporting parts for the diaphragm 18 so as to form part of each pressure chamber. As a result, the rigidity of the supporting parts for the diaphragm 18 of the pressure chamber walls can be increased. Unwanted displacement of the pressure chamber walls 14 at the fixed supporting parts as shown in FIG. 4(B) can thus be prevented.

Example 3

Figure 7:
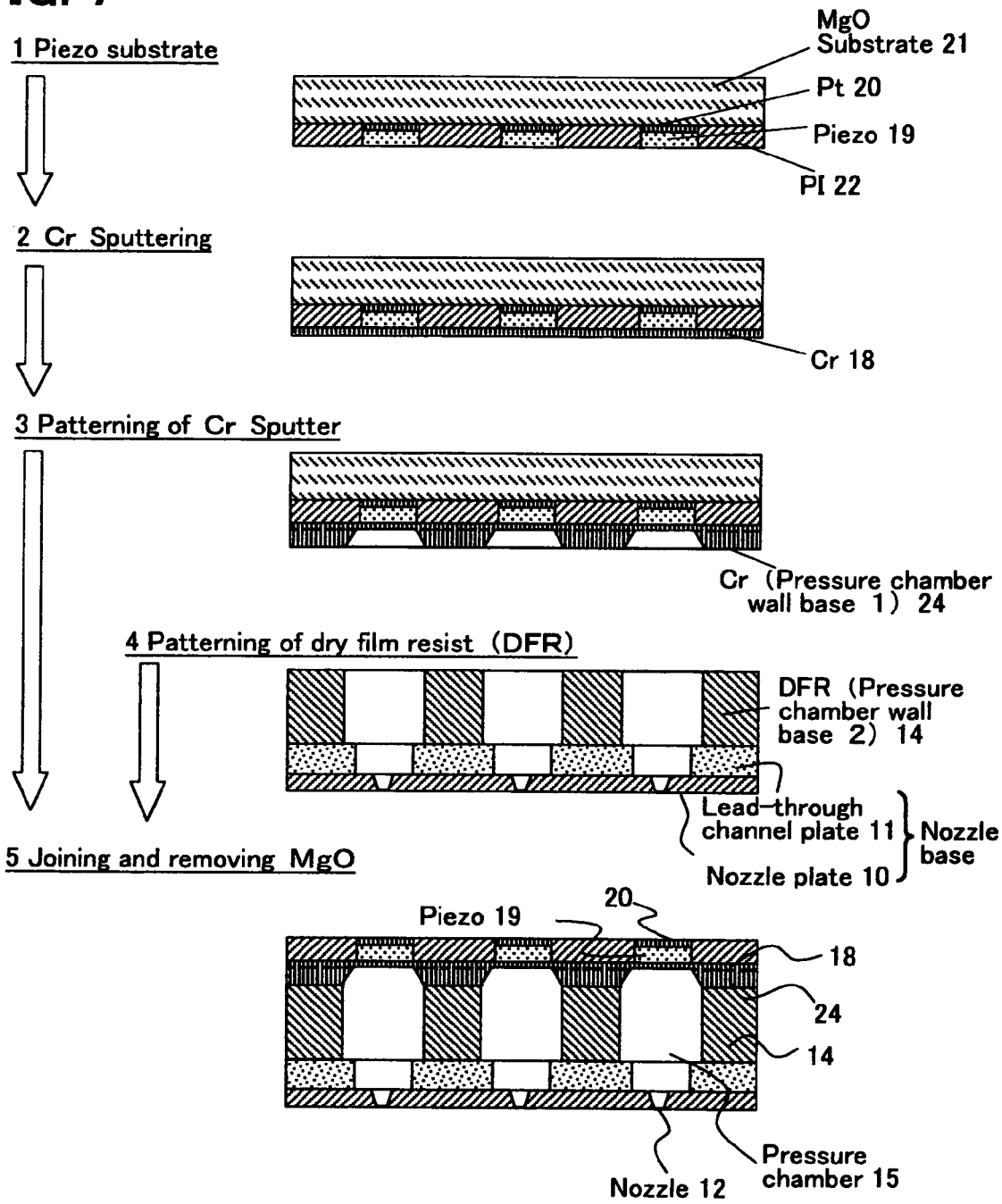
FIG. 7 consists of drawings explaining a third example of the present invention.

FIG. 7 consists of drawings explaining a third example of the present invention. This example is a modification of the second example; in step (3) of FIG. 6, the end face of the sputtering mask is made to have a tapered shape, and hence the cross-section of each of the pressure chamber wall base parts 24 produced by the Cr sputtering is formed into a trapezoidal shape.

The height of the pressure chamber wall base parts 24 is 10 (μm), the width at the top (the piezo side) is 40 (μm), and the width at the bottom (the nozzle side) is 35 (μm). In this example, by providing a taper, stress arising at the diaphragm supporting parts can be relaxed.

Example 4

Figure 8:
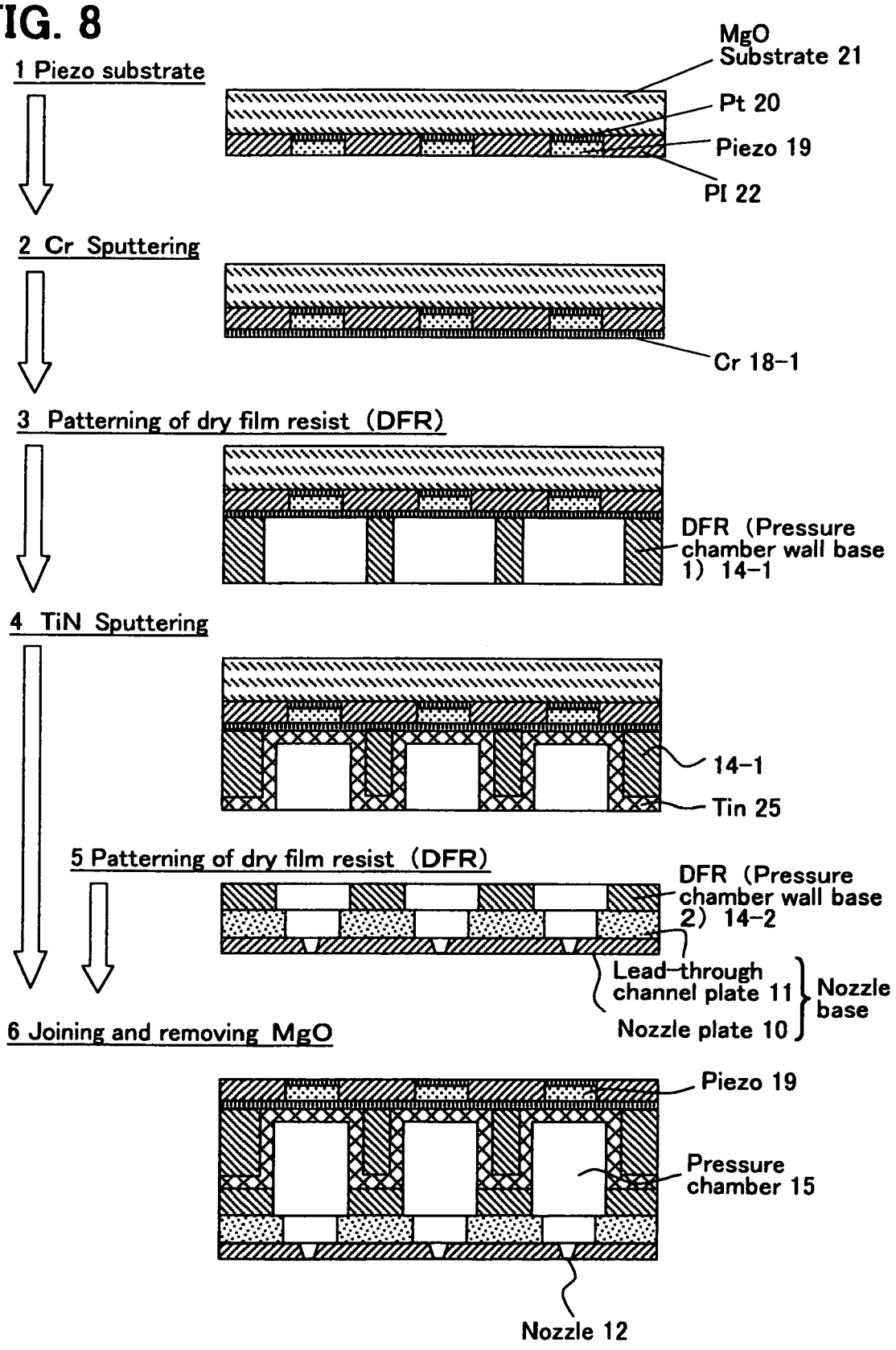
FIG. 8 consists of drawings explaining a fourth example of the present invention.

FIG. 8 consists of drawings explaining a fourth example of the present invention.

(1) A piezo substrate is formed. That is, individual electrodes 20 are formed from Pt on a process substrate 21 (for example MgO), and then piezo films 19 are formed on the individual electrodes 20 by a sputtering method or the like. Moreover, the gaps between the piezo films 19 are made flat using a polyimide (PI) 22.

(2) A common electrode 18-1 is formed over the whole of the piezo substrate of (1) by Cr sputtering. The thickness is 0.1 (μm), which is thin, and hence the common electrode does not function as a diaphragm.

(3) Pressure chamber wall base parts 14-1 are formed by dry film resist patterning on the common electrode 18-1. The height is 29 (μm), and the width is 35−t1×2=33 (μm); regarding t1, see (4) below.

(4) A reinforcing coating layer 25 is formed by TiN sputtering over the whole pattern inside the pressure chambers of (3). The thickness t1 of the coating on the pressure chamber wall surfaces is 1 (μm), and the thickness t2 of the coating on the common electrode 18-1 is 1 (μm).

(5) Pressure chamber wall base parts 14-2 are formed by dry film resist patterning on a nozzle substrate (a laminated plate of a nozzle plate 10 and a lead-through channel plate 11) that has been produced separately. The height is 20 (μm), and the width is 35 (μm).

(6) The members of (4) and the members of (5) are aligned, joining is carried out with heating, and then the piezo substrate MgO 21 is removed by etching, thus completing the manufacture.

In this example, the coating layer 25 that reinforces the pressure chamber walls forms the diaphragm. As a result, deflection of the pressure chamber walls 14 as shown in FIG. 4(A) can be prevented, and moreover deformation of the supporting parts as shown in FIG. 4(B) can also be prevented. Explaining this using FIG. 10, the coating layer 25 on the surfaces of the pressure chamber walls 14 acts as reinforcing beams supporting the coating layer 25 (acting as the diaphragm) on the common electrode 18-1, and hence the supporting rigidity at the ends of the diaphragm is improved, and unwanted displacement of the diaphragm supporting parts is prevented.

Example 5

Figure 9:
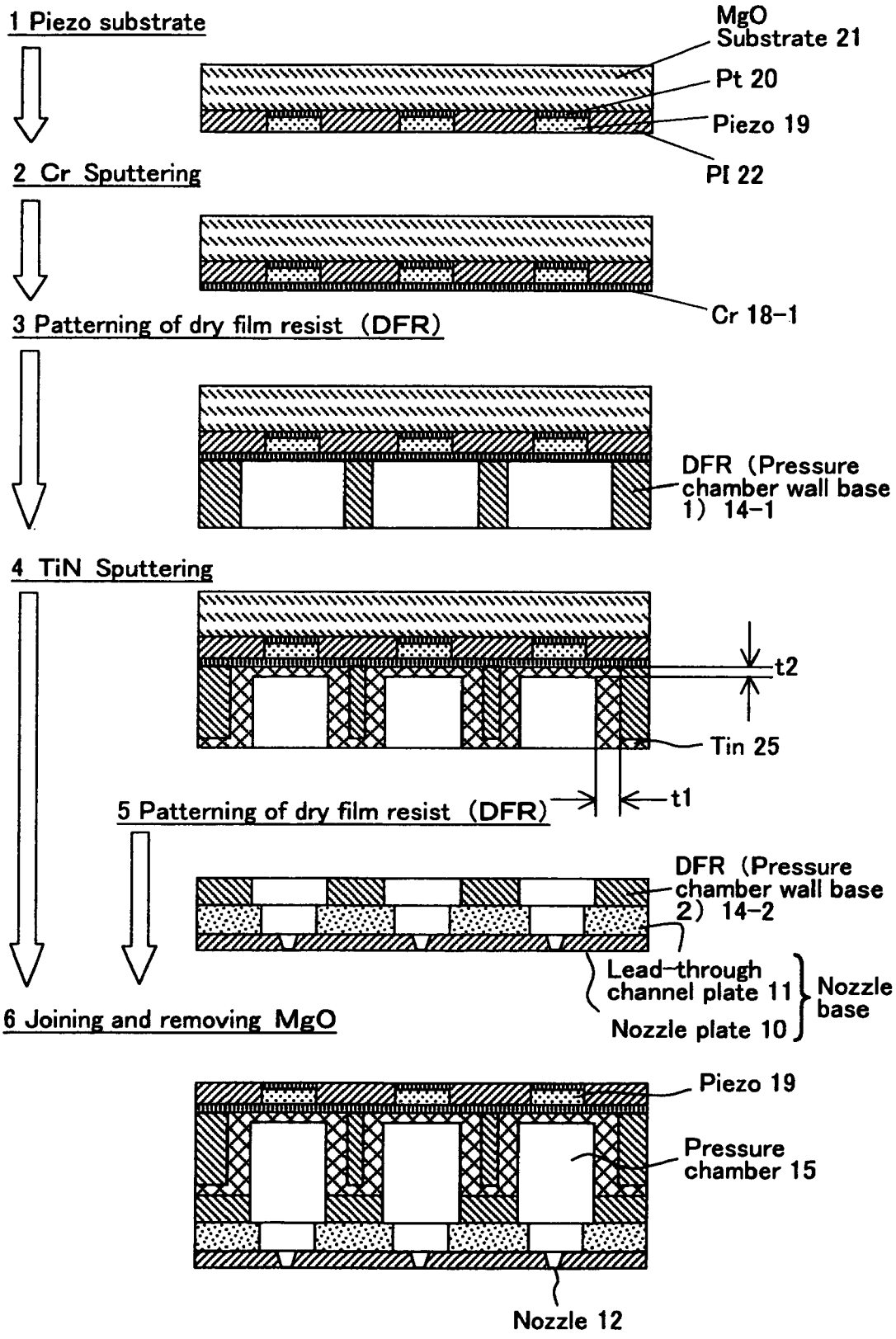
FIG. 9 consists of drawings explaining a fifth example of the present invention.
Figure 10:
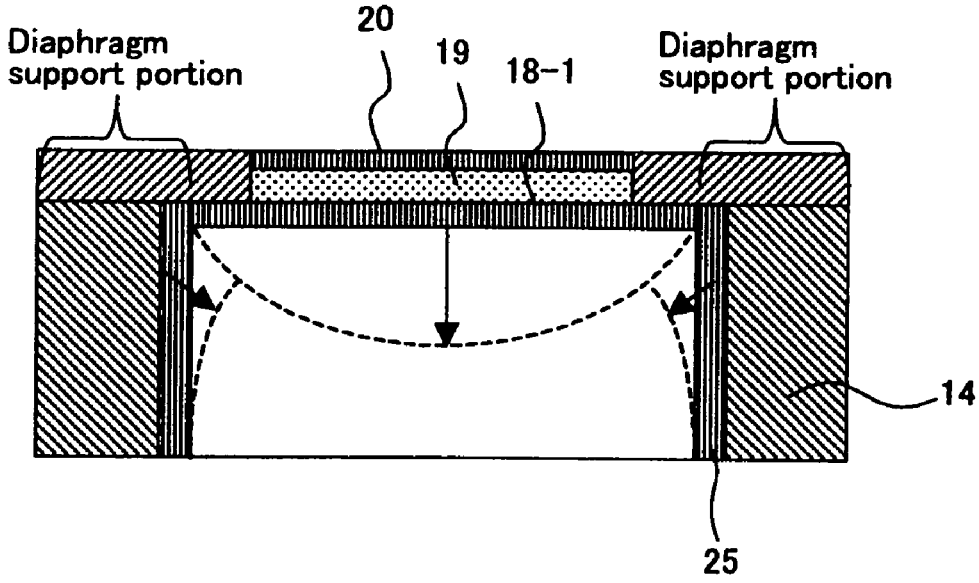
FIG. 10 is a drawing explaining the operation of the fifth example of the present invention.

FIG. 9 consists of drawings explaining a fifth example of the present invention, and shows an example of a modification of the example of FIG. 8. In step (4) in FIG. 8, the TiN sputtering irradiation angle and time are adjusted to make t1>t2. The thickness t1 of the coating on the pressure chamber wall surfaces 14-1 is 5 (μm), and the thickness t2 of the coating on the diaphragm side is 1 (μm). That is, compared with FIG. 8, the coating on the pressure chamber wall surfaces is thicker. As a result, the rigidity of the pressure chamber walls is further increased, but the functioning of the diaphragm is not impaired.

Furthermore, as example 5-2, t1 is made even thicker than in FIG. 9. The thickness t1 of the coating on the pressure chamber walls 14-1 was made to be 10 (μm), and the thickness t2 of the coating on the diaphragm side 1 (μm).

Example 6

Figure 11:
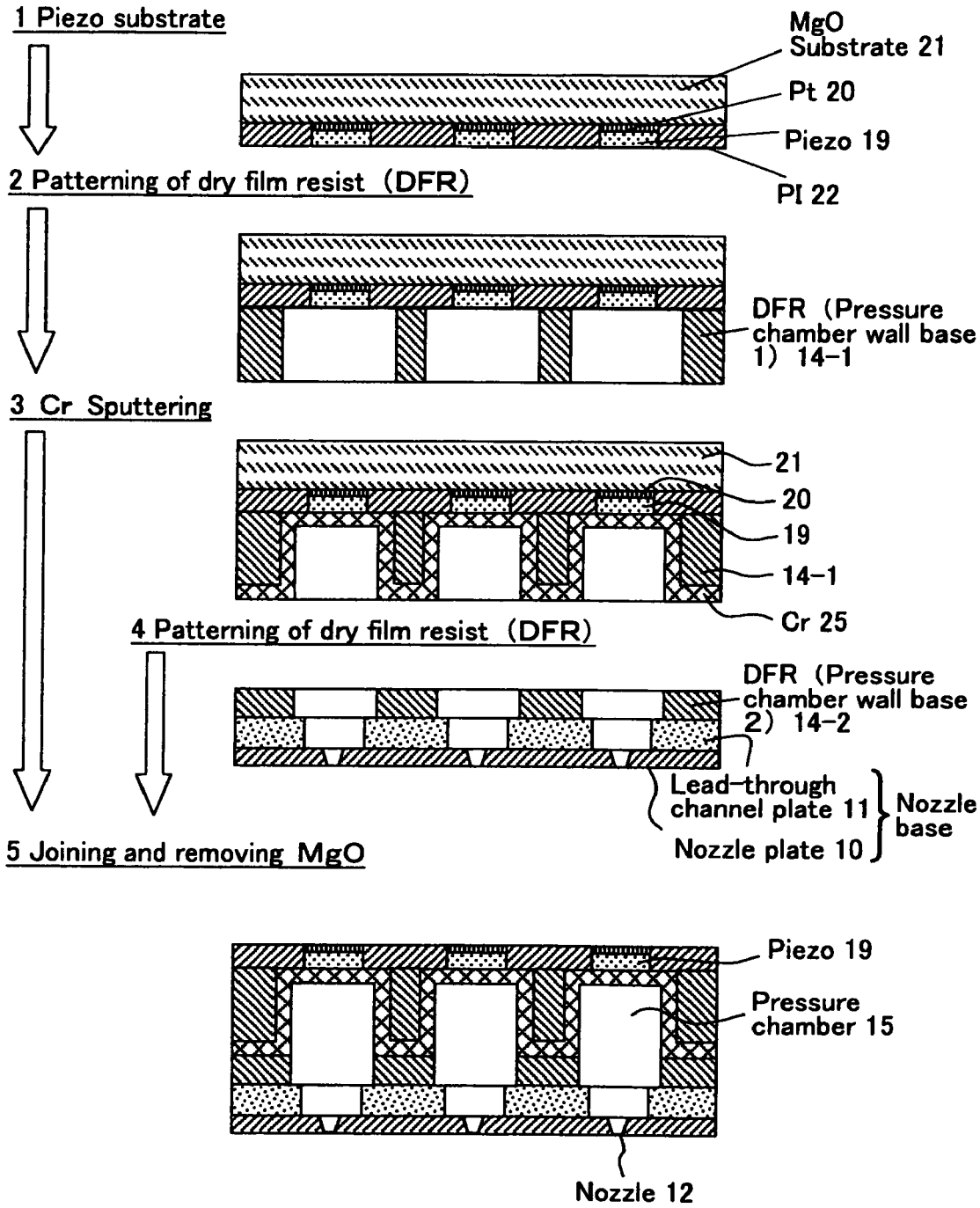
FIG. 11 consists of drawings explaining a sixth example of the present invention.

FIG. 11 consists of drawings explaining a sixth example of the present invention, and shows an example of a modification of the example of FIG. 8. The step (2) of forming the common electrode 18-1 in FIG. 8 is omitted (step reduction), and the coating material of step (3) is made to be an electrically conductive Cr sputtered film 25. As a result, the coating layer 25 formed on the piezo films 19 fulfils the role of a common electrode cum diaphragm, and the coating layer 25 is connected together between the respective pressure chambers. A step can thus be omitted.

Example 7

Figure 12:
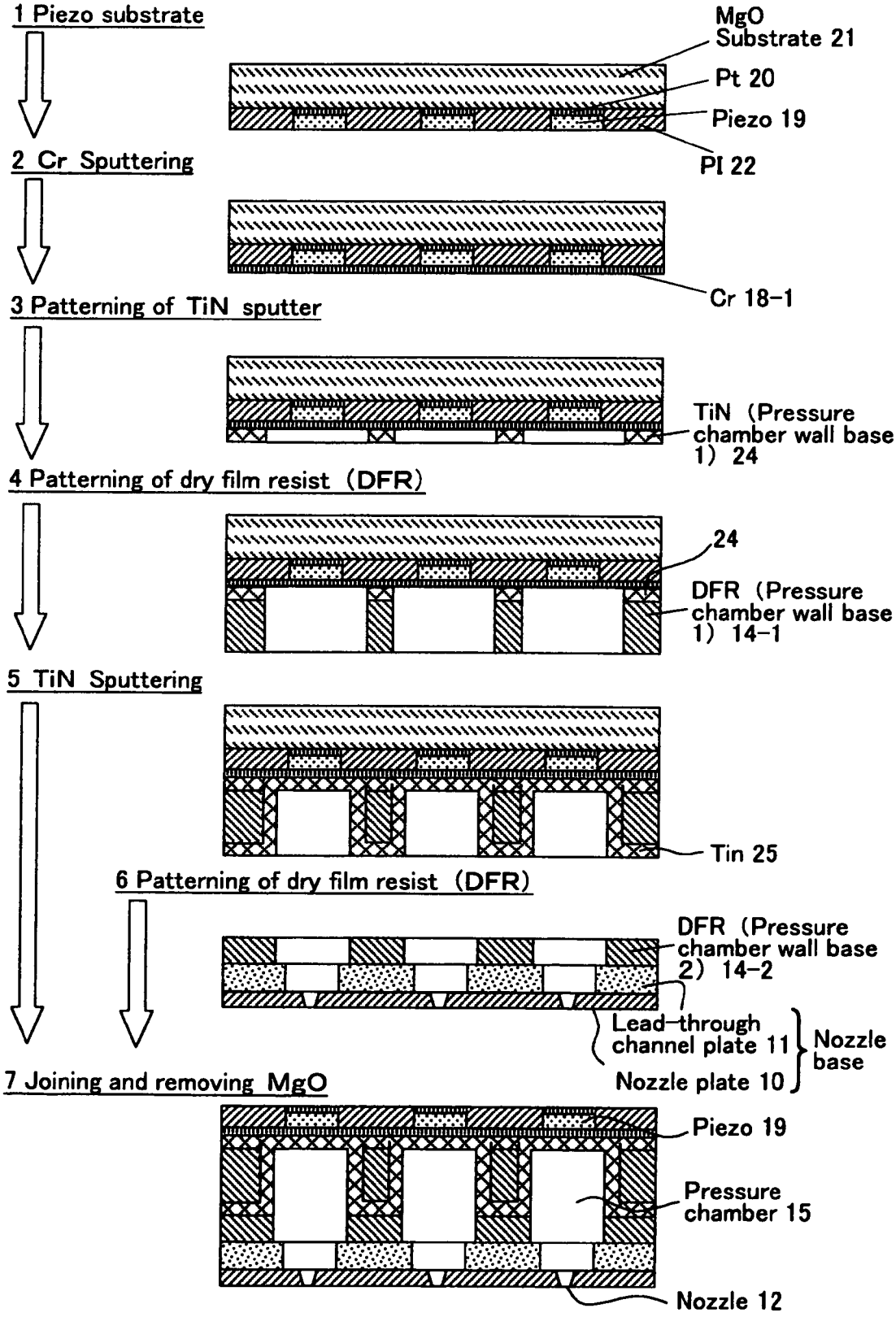
FIG. 12 consists of drawings explaining a seventh example of the present invention.

FIG. 12 consists of drawings explaining a seventh example of the present invention, being a combination of the example of FIG. 6 and the example of FIG. 8.

(1) A piezo substrate is formed. That is, individual electrodes 20 are formed from Pt on a process substrate 21 (for example MgO), and then piezo films 19 are formed on the individual electrodes 20 by a sputtering method or the like. Moreover, the gaps between the piezo films 19 are made flat-using a polyimide (PI) 22.

(2) A common electrode 18-1 is formed over the whole of the piezo substrate of (1) by Cr sputtering. The thickness is 0.1 (μm), which is thin, and hence the common electrode does not function as a diaphragm.

(3) Pressure chamber wall base parts 24 are formed by patterning a TIN sputtered film on the common electrode 18-1. The height is 1 (μm), and the width is 35−t1×2=33 (μm); regarding t1, see (5) below.

(4) Pressure chamber wall base parts 14-1 are formed by dry film resist patterning on the base parts 24. The height is 29 (μm), and the width is 35−t1×2=33 (μm); regarding t1, see (5) below.

(5) A reinforcing coating layer 25 is formed by TiN sputtering over the whole pattern inside the pressure chambers of (4). The thickness t1 of the coating on the pressure chamber wall surfaces is 1 (μm), and the thickness t2 of the coating on the common electrode 18-1 is 1 (μm).

(6) Pressure chamber wall base parts 14-2 are formed by dry film resist patterning on a nozzle substrate (a laminated plate of a nozzle plate 10 and a lead-through channel plate 11) that has been produced separately. The height is 20 (μm), and the width is 35 (μm).

(7) The members of (5) and the members of (6) are aligned and joining is carried out with heating, and then the piezo substrate MgO 21 is removed by etching, thus completing the manufacture.

In this example, the coating layer 25 that reinforces the pressure chamber walls forms the diaphragm. As a result, deflection of the pressure chamber walls 14 as shown in FIG. 4(A) can be prevented, and moreover deformation of the supporting parts as shown in FIG. 4(B) can also be prevented. Explaining this using FIG. 13, the coating layer 25 on the surfaces of the pressure chamber walls 14 acts as reinforcing beams supporting the coating layer 25 (acting as the diaphragm) on the common electrode 18-1, and hence the supporting rigidity at the ends of the diaphragm is improved, and unwanted displacement of the diaphragm supporting parts is prevented. Furthermore, falling in of the diaphragm supporting parts can also be suppressed.

As the method of producing the coating layer, in addition to sputtering as described above, CVD, non-electrolytic plating, vapor deposition or the like can be used; however, so long as the method is such that a reinforcing structure can be realized, there is no limitation to these methods.

Figures 13, 14:
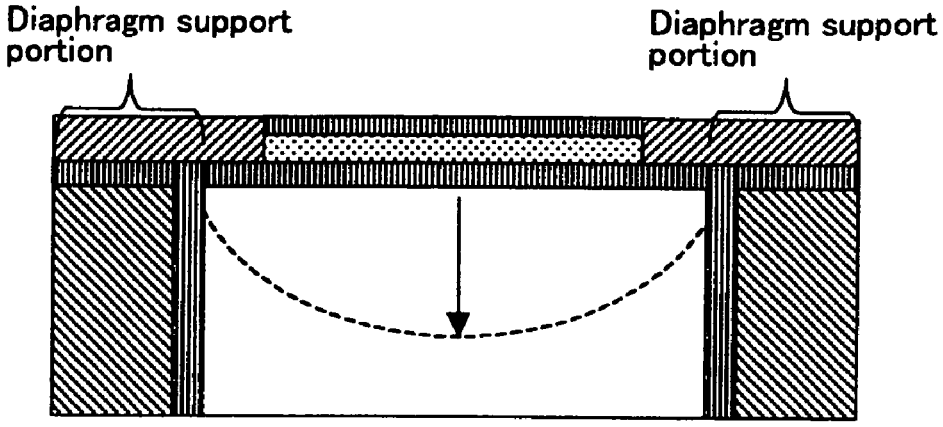
FIG. 13 is a drawing explaining the operation of the seventh example of the present invention.
FIG. 14 is a table of head operating characteristics for the examples of the present invention.
Figure 16:
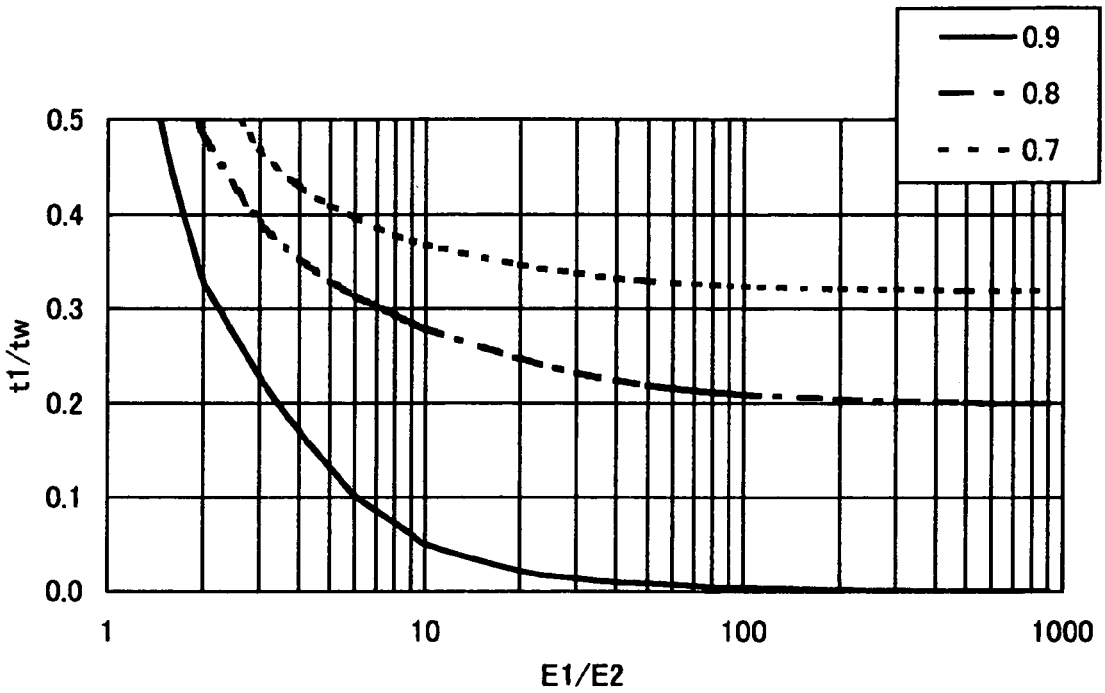
FIG. 16 is a characteristic graph of the pressure chamber wall loss rate for examples of the present invention.
Figure 17:
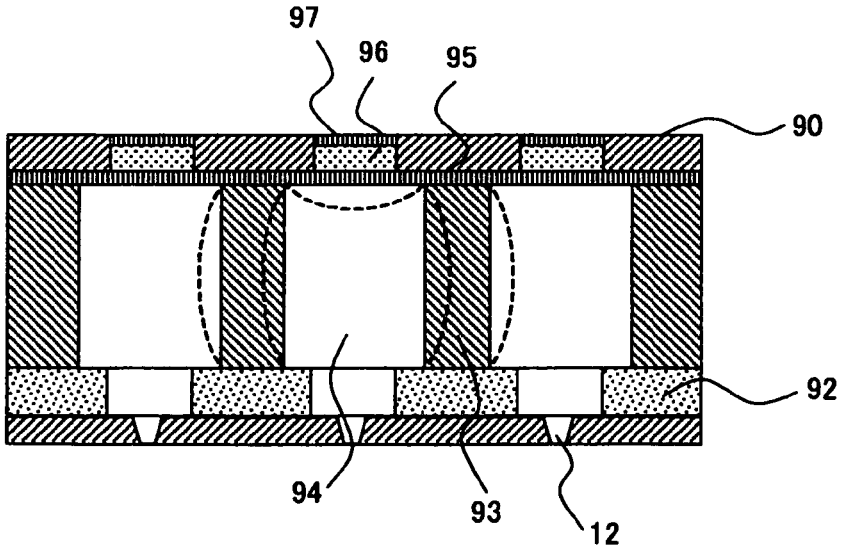
FIG. 17 Prior art
FIG. 17 is a drawing of the constitution of a conventional multi-nozzle ink jet head.

The effects according to Examples 1 to 7 are shown in FIG. 14, FIG. 15 and FIG. 16.

FIG. 14 compares head operating characteristics for Examples 1 to 7 with the conventional example, and shows the Helmholtz frequency and the initial ink particle speed when the ink particle amount is 2 pl (pl: picoliters). For all of the examples, even though the ink ejection structure is the same size as for the conventional example, the Helmholtz frequency and the initial ink particle speed are improved, and it is understood that this will contribute both to improving the ink flight characteristics (in particular improving the particle formation speed of minute particles) and to increasing the nozzle density, which are objects of the present patent, and hence to improving the print quality.

FIG. 15 compares the specific structural effect (the effect of reinforcing the pressure chamber walls) with the conventional example; the results of FIG. 14 are also included, and the values for Examples 1 to 7 are collated for the case that the value for the conventional example is made to be '1'. Here, the effect of reinforcing the pressure chamber walls is represented by the proportion of the pressure chamber wall retreat (pressure chamber wall loss) out of the volume loss during ink ejection (the ink compression in the pressure chamber and the retreat of the pressure chamber wall due to the generated pressure) as calculated by FEM (finite element) analysis.

Clearly, according to Examples 1 to 7, the pressure chamber wall loss is suppressed (the value is less than 1), and as a result the head operating characteristics are improved (the values are greater than 1).

FIG. 16 shows the results of calculations of the pressure chamber wall loss rate according to the rigidity ratio between the core material of the pressure chamber walls and the coating material using the above-mentioned FEM analytical method. Regarding the rigidity ratio between the core material of the pressure chamber walls and the coating material, the following items are taken as parameters.

Parameter (1): E1/E2

Young's modulus of coating material: E1

Young's modulus of pressure chamber wall core material: E2

Parameter (2): t1/tw

Thickness of coating material: t1

Total thickness of pressure chamber wall: tw

From FIG. 16, it can be seen that by using a coating material and shape (thickness) such that the following conditions are satisfied, the pressure chamber wall loss can effectively be suppressed by 10% or more compared with conventionally (t1/tw=0), and the head operating characteristics can be improved as in the examples described earlier.

When 20≦E1/E2, the shape is made to be such that 0.02≦t1/tw.

When 40≦E1/E2, the shape is made to be such that 0.01≦t1/tw.

When 80≦E1/E2, the shape is made to be such that 0.005≦t1/tw.

When 400≦E1/E2, the shape is made to be such that 0.001≦t1/tw.

The present invention has been described through examples above; however, various modifications can be made within the scope of the purport of the present invention, and these are not excluded from the scope of the present invention.

INDUSTRIAL APPLICABILITY

A high-rigidity coating layer is provided on the pressure chamber walls, or a high-rigidity layer is provided on the diaphragm supporting parts, and hence escape of the pressure chamber walls, which are thin and of low rigidity, can be suppressed, the Helmholtz frequency is raised, and the particle formation speed and the driving frequency are increased. This contributes to increasing the printing speed, and to making the dots finer (making the ink particles smaller), i.e., improving the print quality. In particular, in the case of a bimorph diaphragm structure using a thin-film piezo of thickness 5 μm or less as an actuator, the effects are marked, and there is a great contribution to increasing the nozzle density and making the head smaller.

What is claimed is:

1. A method of manufacturing a multi-nozzle ink jet head having a plurality of nozzles and a plurality of pressure chambers, comprising the steps of:

producing piezoelectric type actuators having a diaphragm and a plurality of piezo elements;

forming, on the piezoelectric type actuators on a side of the diaphragm opposite to the piezo elements, first pressure chamber wall base parts constituting a portion of the piezoelectric type actuator side of dividing walls of the plurality of pressure chambers;

superimposing, on a side of the first pressure chamber wall base parts opposite from the piezoelectric type actuators, second pressure chamber wall base parts constituting a portion of the dividing walls in such a manner that the first pressure chamber and the second pressure chamber wall base parts constitute the dividing walls; and forming a nozzle member in which the plurality of nozzles correspond to the plurality of pressure chambers divided by the dividing walls having the first pressure chamber wall base parts and the second pressure chamber wall base parts, wherein the first pressure chamber wall base parts each include a high rigidity member having a higher rigidity than the second pressure chamber wall base parts.

2. The method of manufacturing a multi-nozzle ink jet lead as defined in claim 1, wherein the high rigidity member has a taper shape such that the high rigidity member gets wider gradually toward the diaphragm.

3. The method of manufacturing a multi-nozzle ink jet lead as defined in claim 1, wherein the high rigidity member is formed on a core material of each of the dividing walls of the plurality of pressure chambers.

* * * * *